US007448102B2

(12) United States Patent
Milligan et al.

(10) Patent No.: US 7,448,102 B2
(45) Date of Patent: Nov. 11, 2008

(54) METHOD FOR CONTROLLING MIXTURES ESPECIALLY FOR FABRIC PROCESSING

(75) Inventors: William D. Milligan, Matthews, NC (US); E. Scott Allison, Kannapolis, NC (US); Eric A. Best, Lexington, NC (US)

(73) Assignee: Tubular Textile Machinery, Inc., Lexington, NC (US)

( * ) Notice: Subject to any disclaimer, the term of this patent is extended or adjusted under 35 U.S.C. 154(b) by 19 days.

(21) Appl. No.: 11/435,574

(22) Filed: May 16, 2006

(65) Prior Publication Data

US 2006/0260067 A1 Nov. 23, 2006

Related U.S. Application Data

(60) Provisional application No. 60/682,974, filed on May 20, 2005.

(51) Int. Cl.
*D06B 3/00* (2006.01)
*G05D 11/00* (2006.01)

(52) U.S. Cl. ..... 8/158; 8/151; 8/147; 137/3; 137/15.18; 137/15.19; 137/88; 137/101.25; 137/111; 137/93

(58) Field of Classification Search ..... 8/151, 8/147, 158; 68/13 R, 207 R, 5 D; 137/3, 137/15.18, 15.19, 88, 93, 101.25, 111
See application file for complete search history.

(56) References Cited

U.S. PATENT DOCUMENTS 4,620,338 A * 11/1986 von der Eltz et al. ..... 8/151
5,010,612 A * 4/1991 Jensen et al. ..... 8/149.1
5,512,062 A * 4/1996 Fuller et al. ..... 8/499
6,067,151 A 5/2000 Salo
6,766,818 B2 * 7/2004 Kashkoush et al. ..... 137/3
2002/0104171 A1 * 8/2002 Clark et al. ..... 8/158
2005/0172679 A1 * 8/2005 Bellini et al. ..... 68/13 R

FOREIGN PATENT DOCUMENTS

IT WO03/010228 * 12/2003

OTHER PUBLICATIONS

K-Patents Brochure, date unknown, but prior to our provisional filing date of May 20, 2005, 6 pages.

* cited by examiner

*Primary Examiner*—Lorna M. Douyon
*Assistant Examiner*—Tri V Nguyen
(74) *Attorney, Agent, or Firm*—Schweitzer Cornman Gross & Bondell LLP

(57) ABSTRACT

A method for supplying liquid mixtures on a mix-on-demand basis for consumptive use, and for maintaining the composition of such mixture on a highly accurate and stable basis. For wet-on-wet processing of fabrics, the processing solution is supplied at start-up on a mix-on-demand basis to precise specifications and is maintained at such precise specifications throughout fabric processing, which involves continuous additions of water by the incoming fabric and removal of solution by the exiting fabric. Recirculation of the solution at a high rate, together with rapid and repetitive measurements of the composition of the recirculating solution enables the solution to be precisely monitored and maintained. Periodic small additions of chemical are injected as necessary to maintain highly stable, accurately controlled process conditions. Extraordinary economies, both direct and indirect, can be realized with the new system.

5 Claims, 8 Drawing Sheets

59
63
60
66
64
61
67
65
62
68
69
69

METHOD FOR CONTROLLING MIXTURES ESPECIALLY FOR FABRIC PROCESSING

RELATED APPLICATIONS

This application is based upon, and claims the priority of, provisional application Ser. No. 60/682,974, filed May 20, 2005.

BACKGROUND OF THE INVENTION

In the processing of fabrics, it is frequently necessary or desirable to impregnate the fabric with chemicals, such as fabric softeners, resins, fabric performance chemicals, stain resists, resins, fabric performance chemicals, etc. This is conveniently done while the fabric is in web form, when it can be run continuously through a solution bath. As the fabric exits the solution, it typically is passed through a pair of extraction rollers which squeeze out the excess processing liquid. The impregnated fabric is then dried, or dried and cured, or dried and cured, and subjected to further processing.

Inasmuch as wet fabric more easily absorbs processing solution, it is typical for the fabric to be wet-out prior to being immersed in the processing solution. The wet-out procedure desirably is performed closely upstream of the chemical processing, in order that the fabric entering the processing solution will have a substantially uniform and controlled content of water.

When the wet-out fabric enters the bath of chemical solution, it absorbs excess quantities of the solution. As the fabric exits the solution, and passes through the extraction rollers, excess liquid is pressed out of the fabric and falls back into the solution pan, and the fabric emerging from the exit side of the extraction rollers carries away a predetermined, uniform quantity of the solution. Inasmuch as the fabric entering the solution bath already carries a significant quantity of water, the process of impregnating the fabric in the solution bath and then extracting excess solution upon exit tends to result in a progressive dilution of the solution bath over time, because more water is being brought in to the solution than is being carried away by the processed fabric.

With conventional and accepted practices, it is customary to process on a batch basis, in which a quantity of the processing solution is prepared in a pre-mix tank and is supplied from the pre-mix tank to a processing pan, through which the fabric is guided. During processing, the pre-mixed solution is periodically supplied from the pre-mix tank to the processing pan, according to a level control facility associated with the pan. Because of the continuous dilution of the chemical solution in the processing pan during operations, it is customary to provide a solution pre-mix that contains a substantially higher concentration of the process chemical than is required for the fabric. For example, where the desired solution contains 2.5%-3% solids, the conventional pre-mix solution will have a typical concentration of about 7% solids. The initial run of fabric passing through the solution will thus pick up the processing chemical at the 7% level, which of course imparts to the fabric a much greater quantity of the chemical than is needed (or even desired). Over a period of time, for example, 20-30 minutes, the solids concentration in the solution pan becomes progressively less, as the periodic replenishment of the solution pan with 7% solids mixes with a progressively more dilute solution in the pan resulting from water introduced from the incoming fabric. After an initial 20-30 minute period, a substantial equilibrium is reached, at which the periodic replenishments from the 7% solids pre-mix solution are substantially balanced by the incoming dilution, as wet fabric continues to enter the solution pan, adding water, and chemical and water are carried away by the processed fabric.

In conventional processing, it is also generally considered necessary for the above described equilibrium level of the processing solution to be set at a level somewhat higher than the desired specification for the processed fabric, because of the many variables that enter into the eventual equilibrium condition. Among other things, the processing bath is replenished periodically with a 7% solids solution. Also, the time to reach an equilibrium point can vary as a function of the width and weight of the fabric being processed, as well as a function of the throughput speed.

The losses to the fabric processor resulting from overapplication of processing chemicals, as described above for conventional processing, can be truly staggering. In a processing operation having a production rate of 200,000 pounds per week treated with a soil release chemical, for example, direct losses from overapplication of the soil release chemical, based upon chemical costs alone, can exceed $400,000 per year. Moreover, the losses from such overapplication of chemicals are not limited to the chemical costs, but involve downstream processing as well. For example, during the drying of fabric after chemical processing, some of the chemical becomes deposited internally in the dryer, necessitating occasional maintenance cleaning. Where excess quantities of the chemical are being carried by the fabric, maintenance cleaning must be done more frequently, with resulting expense and downtime. Additionally, subsequent compressive shrinking operation are less effective and less satisfactory when the fabric is carrying excessive amounts of processing chemicals.

Under-application of chemicals to a fabric can also result in costly losses. For example, under-application of chemical over a portion of the fabric, may result in the fabric being not up to quality control specifications and rejected on that basis. With conventional processing, the solution becomes progressively more diluted over time and in many cases is diluted to a level below the percent solids which is standard for the process. In those cases, it frequently is necessary to stop the process, drain and discard the dilute solution, and refill the pan with new solution. This, of course, requires a new equilibrium period to take place, as the solids concentration of the new solution gradually dilutes toward the desired standard percentage of solids. Some processors may discard as much as $2000.00 per week of solution which has become diluted below standard as regards percent solids. Stoppage of the continuous processing line during drain and refill procedure further exacerbates the losses experienced by the processor. With the system of the present invention, losses of this type are reliably avoided, because the processing solution can be maintained on specification with a high degree of accuracy and reliability.

An additional advantage of the invention is derived from the fact that certain procedures, which are now performed on a wet-on-dry basis, because of difficulty in performing them with conventional wet-on-wet procedures, can now be performed to significant advantages as wet-on-wet procedures. Among other things, this saves the cost and time of performing an intermediate drying step on the fabric, prior to performing wet-on-dry chemical processing. Additionally, both fabric strength and shrinkage are improved with wet-on-wet application, as compared to wet-on-dry processing.

SUMMARY OF THE INVENTION

The present invention is directed to a novel and improved apparatus and process for controlling processing solutions with an exceptionally high level of accuracy. The invention is uniquely advantageous in connection with the wet-on-wet processing of fabrics, but is not necessarily limited thereto. The apparatus and procedure of the invention, in broadest context, involves the mixing and controlling of a processing solution during a consumptive use of the processing solution, on a "mix-on-demand" basis, such that the components of the processing solution are introduced only as and to the extent needed, and on a precision basis. The arrangement, according to the invention, is such that the processing solution is controlled with a high degree of precision throughout the consumptive use thereof, allowing the chemical usage to be kept at an absolute minimum for the processing requirements.

In a particularly preferred embodiment of the invention, for the application of processing chemical on a continuous basis to a moving fabric web, the processing solution is continuously controlled with a high level of precision to assure that the fabric is properly treated throughout with the chemical solution. At the same time the process of the invention avoids the need for overapplication of chemicals otherwise required to accommodate an initial equilibrium period and/or to provide for a "factor of safety" to accommodate process variables. Because the procedure of the invention enables the fabric processing to be carried out with a high level of precision in the control of the processing solution, the usual processing variables are reduced to insignificance, and applying extra chemicals to achieve a factor of safety can be minimized to an insignificant level.

In a preferred process according to the invention, previously wet-out fabric is guided through a solution pan containing a quantity of a chemical processing solution, such as a fabric softener or soil release chemical, for example. Desirably, the solution pan is quite small in relation to the required size of a solution pan used in conventional processing. For example, in a typical line for processing tubular knitted fabric of about 26 inch width, a pan of 3.5-5 gallon solution capacity is preferably utilized, as compared to solution pans of 10-13 gallons capacity which are more commonly utilized for conventional processing. For some processes, such as treating wide, open width fabrics, the solution pan may be much larger than 3.5-5 gallons. Nevertheless, for the processing of comparable fabrics, the solution pan used in the process of the invention typically and desirably is significantly smaller than that required for conventional processing During processing of the fabric, wet fabric enters the solution bath and typically passes through a series of rollers to assure a uniform penetration of the fabric by the processing solution. As the fabric exits the solution pan, it passes through a pair of extraction rollers that remove excess liquid, allowing it to flow back into the solution pan. While the processing of the fabric continues, the processing solution contained in the solution pan is rapidly and continuously recirculated and its composition tested so as to detect any changes in the concentration of processing chemical. Preferably, the total content of the solution pan is completely recirculated multiple times per minute. During the continuous recirculation, the solution is exposed to an in-line sensor, which accurately measures the content of processing chemical in the stream of recirculating solution. The recirculating stream is sensed rapidly and repetitively, for example, about once every second. Any time the sensor senses the solution to be out of specification, a small amount of a needed component is injected into the flowing system and immediately thoroughly mixed therewith. Because of the high rate of recirculation of the solution, and the high speed, repetitive monitoring and correcting of the solution, it is possible to maintain the solution within an extremely low tolerance range above or below a desired set point throughout the entire fabric processing.

The new process is able to assure with a high degree of certainty that the fabric will be uniformly penetrated by a desired level of the process chemical without requiring the chemical to be overapplied in significant amounts as has been required with conventional processing.

The initial solution concentrate supplied in the process of the invention is mixed on demand and adjusted on demand as required in order to maintain a precise and uniform solution notwithstanding the constant introduction into the solution of non-specification liquid (e.g., water) being brought into the solution by the incoming fabric.

The system of the invention enables a high level of factory performance to be achieved by pre-setting appropriate processing mixtures for various fabrics and for various purposes and storing those pre-set mixtures in a processor memory for individual selection. Operator judgment (or lack thereof in many instances) can be eliminated from the process through the use of such pre-set procedures, the control of which can be limited to supervisor levels.

For a more complete understanding of the above and other features and advantages of the invention, reference should be made to the following detailed description of a preferred embodiment, and to the accompanying drawings.

DESCRIPTION OF A PREFERRED EMBODIMENT

Figure 1:
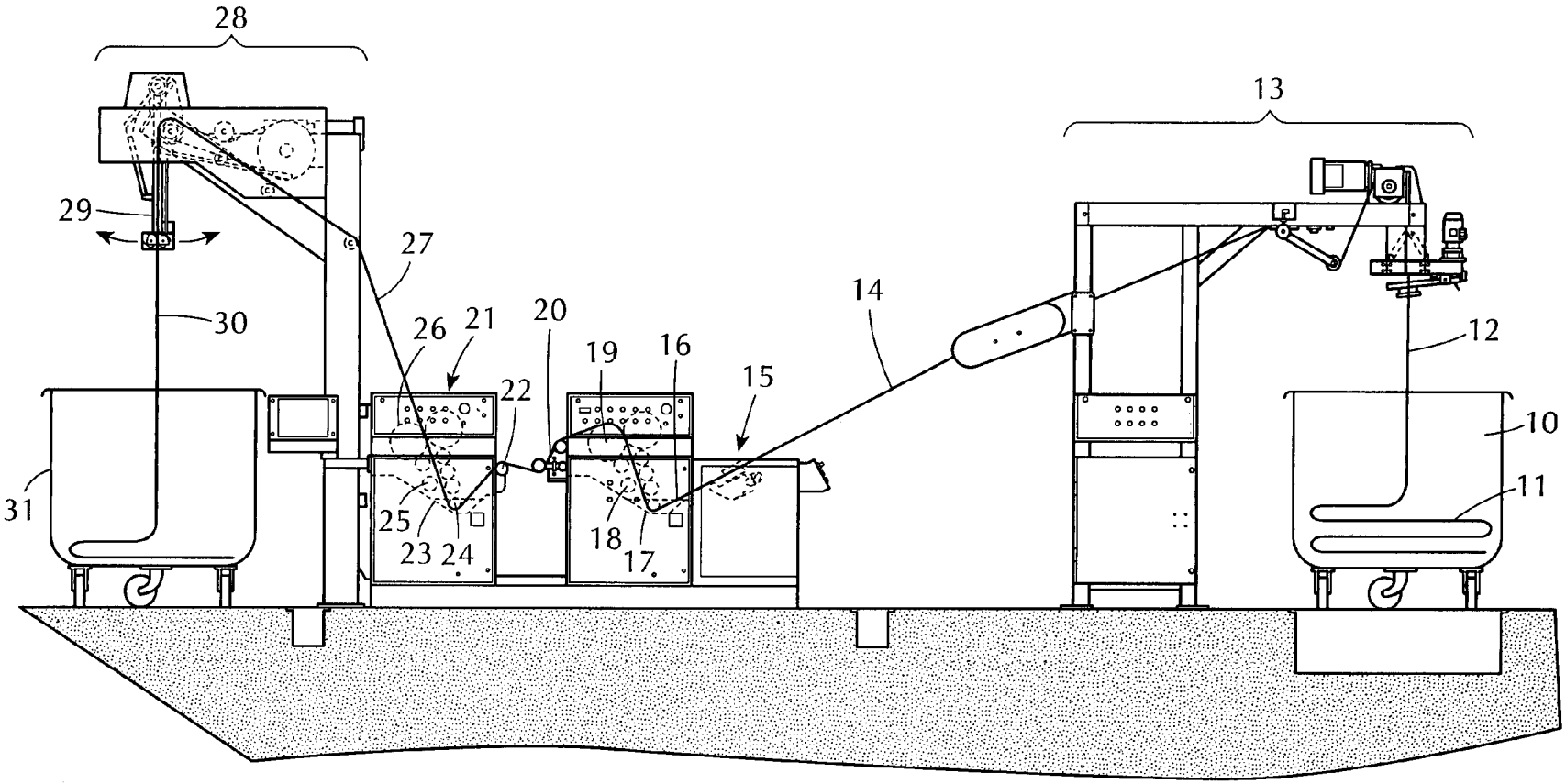
FIG. 1 is a simplified view of a representative processing installation employing the method and apparatus of the invention.

Referring now to the drawing, and initially to FIG. 1 thereof, there is shown a typical fabric processing line on which the method and apparatus may be employed to great advantage. The processing system shown in FIG. 1 includes a supply truck 10, which holds a supply 11 of fabric to be processed. In the illustration, it is contemplated that the fabric 11 may be tubular knitted fabric, although the invention is not limited thereto. The fabric 11 in the truck will have been previously processed by washing, bleaching, etc. and typically will be in "rope" form in the truck 10. The fabric is drawn out of the truck at 12 and passes through a de-twisting mechanism, broadly indicated at 13. In this respect, the rope form fabric within the supply truck 10 typically may be in a thoroughly twisted condition from prior processing and needs to be untwisted so that the fabric tube can be expanded, its stitch lines aligned, etc. for the final processing stages.

The de-twisted tubular fabric 14 next passes over a spreader mechanism 15. The spreader mechanism is a known mechanism that laterally distends the fabric to a flat form of uniform width. The spread fabric 16 is directed into a extractor stage which comprises a pan 17 filled with water. The fabric enters the pan 17 and then is directed upwardly between sets of squeeze rollers 18. The wet fabric then passes between a pair of resiliently covered extraction rollers 19, which squeeze excess water out of the fabric, allowing it to drain downwardly toward the pan 17.

Fabric 20 exiting the extraction rollers 19 is in a uniformly wet-out condition over its entire area. Although the fabric drawn from the supply truck 10 typically is wet from prior processing, it typically has been retained for some time in the truck, such that water has drained somewhat from upper portions of the fabric pile, while the lowermost portions of the fabric pile may be immersed in liquid drained from upper portions. Fabric extracted from the truck thus is not uniformly wet throughout which is desired for the further processing.

The desired chemical processing according to the invention is carried out at the processing station 21. Physically, the processing station 21 may be quite similar to the extractor station in which the fabric is subjected to a wet-out operation. Thus, the wet fabric 20 passes over an entry roller 22 and downward into a solution pan 23. In the solution pan, the fabric is directed underneath a roller 24, which is below the level at which processing solution is maintained in the pan, and then directed upwardly between sets of ballooning rollers 25 and finally through a pair of resiliently covered extraction rollers 26. The fabric 20 passing into and through the processing station 21 is processed in a particularly advantageous manner according to the invention, as will be hereinafter described in more detail.

The processed fabric 27, now uniformly impregnated with desired quantities of processing chemical, is transferred upward into a folding apparatus identified generally by the reference numeral 28. The folding apparatus, in itself well known, includes reciprocating folding arms 29, which oscillate forward and backward corresponding to the rate of travel of the incoming fabric. The fabric 30 exiting the reciprocating folding arms 29 is in a flat, two-layer form and is deposited in neat back and forth folds in a receiving truck 31. At the end of a processing batch, the truck 31 is taken to a dryer system (not shown), where the excess moisture is evaporated from the fabric and the chemical applied to the fabric is cured. Upon exit from the dryer, the fabric may be passed through one or more compressive shrinking stages (not shown). A tubular knitted fabric tends to get distended lengthwise to a significant degree during initial processing. If not compensated for, this can result in excessive shrinkage in the finished fabric. Accordingly, one of the last processing stages for such fabric typically is compressive shrinkage in the length direction in order to eliminate most or all of such residual shrinkage.

Figure 3:
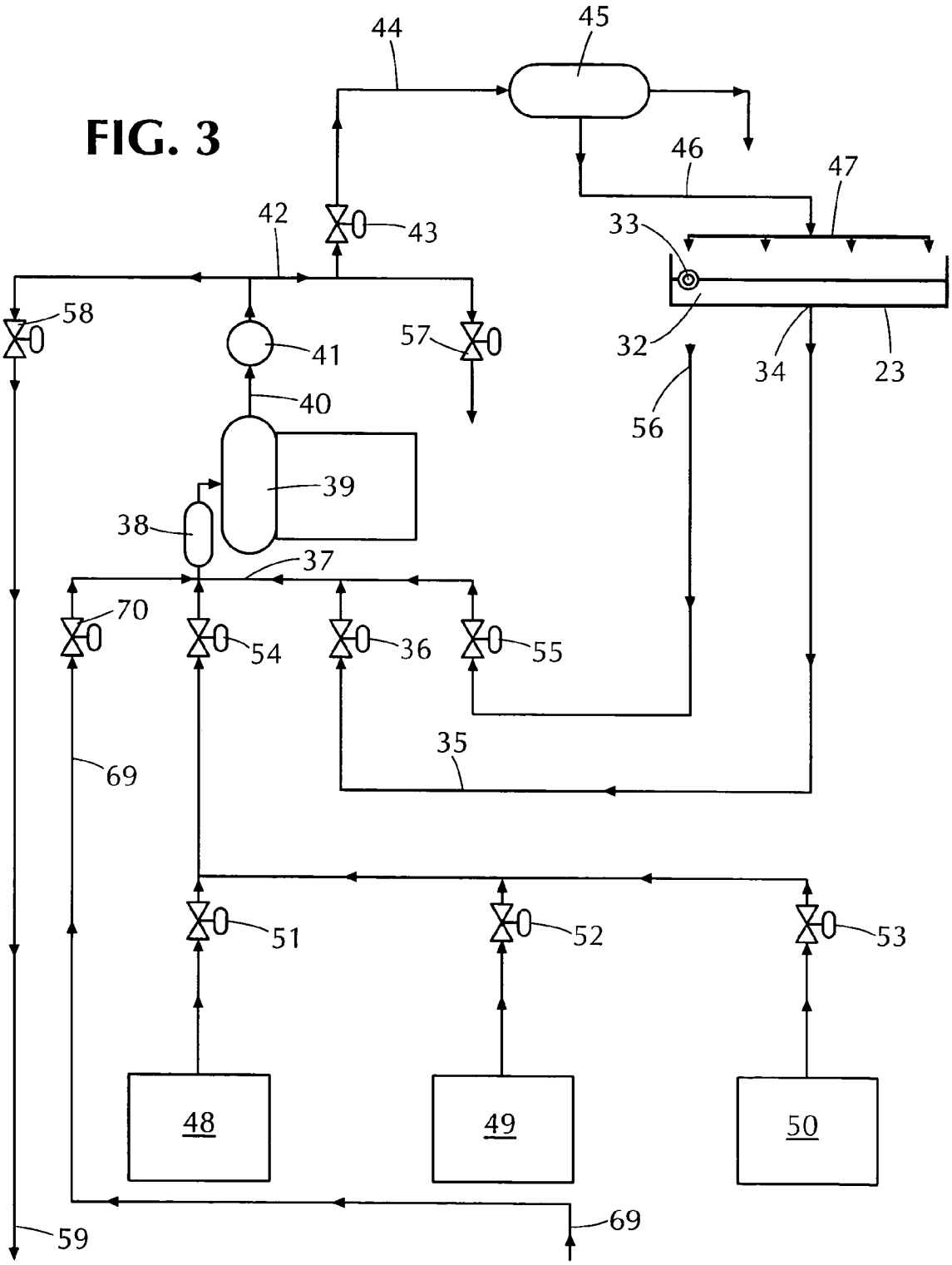
FIGS. 3 and 4 are a simplified component diagram showing elements used in a typical system according to the invention.

The processing system according to the invention, which is embodied in the processor station 21 of FIG. 1, is shown in diagrammatic form in FIG. 3. In FIG. 3, the solution pan 23 is shown containing a supply 32 of processing solution which is normally held at a predetermined level in the pan by a level sensor 33. As reflected in FIG. 1, the front and back portions of the bottom wall of the solution pan 23 are angled upwardly in somewhat of a shallow V-shaped configuration to minimize dead areas in the solution pan as well as to minimize the overall liquid volume to be contained within the solution pan as compared to the requirements of conventional processing. In this respect, in a typical fabric processing line according to the invention, for processing fabrics up to sixty inches in width, the processing pan 23 advantageously has a relatively minimal capacity of 3½-5 gallons of processing solutions, as determined by the setting of the level sensor 33. While the size of the pan 23 is not critical, and typically will vary with different fabric width capacity, the process of the invention enables benefits to be realized through the use of a relatively smaller processing pan than would otherwise be required.

The solution pan 23 is provided with a drain 34 at the lowest point, which leads through a line 35 and a solenoid valve 36 to a pump inlet manifold 37. The inlet manifold connects through a static mixer unit 38 to a high capacity circulation pump 39. The pump 39 discharges through a line 40 in which is installed a special in-line sensor 41. The sensor directs a beam of light at the liquid flowing through the line 40, sensing the characteristics of the refracted and reflected light from the flowing liquid. This is internally compared against a database of characteristics for the particular processing solution, triggering adjustments in the solution if necessary, all as will be more fully explained.

After passing through the sensor 41, the solution flows through a line 42, a solenoid controlled recirculation valve 43, and a line 44 to a filter device 45 which eliminates lint and other debris which may have been released by the fabric being processed. From the filter 45, the processing solution flows through a line 46 to one or more distributors 47, which return the solution to the pan 23. Preferably, there are two such flow distributors 47, one at each side of the pan, to maximize distribution of the returned solution within the pan.

Effective filtration of the recirculating solution is particularly desirable in the process of the invention in order to avoid clogging of the recirculation system with lint, which is brought in with the incoming fabric and deposited in the solution pan. Additionally, clearing lint from the solution both improves the accuracy of the sensor readings but also results in a higher quality of product output by minimizing the redeposit of clumps lint and/or debris onto the fabric during processing. To this end, the filter system 45 preferably comprises a Vibro-Energy separator, marketed by Sweco, Florence Ky. The recirculated flow of solution is deposited onto a vibrating screen of the separator, which retains and discharges the lint fibers and other debris while allowing the separated processing solution to pass through and be returned to the solution pan.

Pursuant to one aspect of the invention, the recirculation pump 39 and the various lines leading to and from the pump, are of such a capacity as to enable the entire volumetric content of the solution pan 23 to be recirculated several times within the period of a minute. For example, for a solution pan of 3½-5 gallons capacity, it is contemplated that the recirculation system will recirculate solution at the rate of about 19 gallons per minute. Thus, even though the wet-out fabric 20 entering the solution pan 23 is constantly bringing in a dilutive water content, the low volumetric capacity of the solution pan and the high rate of recirculation thereof, recirculating the entire volume of the pan in about 12 seconds, assures that this incoming dilutive medium is immediately and thoroughly mixed into the solution volume as a whole.

Notwithstanding that the incoming dilutive water is virtually instantaneously uniformly mixed into the overall solution, the constant addition of the water and the constant removal of processing chemical, carried by the processed fabric, will tend to dilute the chemical content of the processing solution 32. Accordingly, and as a feature of the invention, the content of the processing chemical is measured rapidly and repetitively by the sensor 41. In the illustrated and preferred form of the invention, the measurement is repeated at intervals of approximately 1.2 seconds, and control is based upon a moving average of, for example, four successive measurements. In a preferred system, an initial setting is made for the desired percent solids content of the processing chemical. For a soil resist, a suitable set point may be 2.5% solids. With the system of the invention, it can be expected to maintain the set point concentration within a tolerance of plus/minus 0.05%, which is an extraordinarily high level of accuracy. The high level of accuracy is in part assured by reason of the high rate of recirculation flow of the processing solution past the sensor, which serves to maintain the surface-contacting prism of the sensor very clean and free of build-up of deposited materials.

In the illustrated system, processing chemical can be obtained from any one of three supply containers 48-50, which contain different chemical solutions and can be selectively connected to the system through valves 51-53. For a particular processing run, only one container would be selected, for example, the container 48, in which case the valve 51 would be open and valves 52, 53 would be closed. The container 48, by way of example may contain a stain resist chemical, which may be supplied as a 28% liquid solution.

When the sensor 41 detects even a minute lowering of the chemical percent solids from the desired set point, a solenoid valve 54 is opened momentarily, for example, for a period of 450-500 milliseconds (ms). A measured small quantity (micro-addition) of processing chemical enters the system upstream of the pump 39 and upstream of the static mixer 38. The newly added chemical thus joins the recirculating processing solution flowing into the inlet manifold 37 and the two liquids enter the static mixer 38. In the static mixer, the flowing stream is subjected to a high level of turbulent mixing, such that the materials entering the pump 39 are thoroughly and uniformly mixed for passing before sensor 41.

Based upon a moving average of four measurements or so from the sensor 41, taken every 1.2 seconds, there can be several micro-additions of chemical from the supply 48 to bring the processing solution back into specification. However, inasmuch as the entire volumetric content of the solution pan is recirculated in approximately 11-16 seconds, overadding of the chemical is readily avoided, and the chemical content of the solution bath can be easily maintained within extremely tight tolerances of plus or minus 0.05% from the desired set point.

The process envisioned herein is essentially a consumptive process, in which processing solution is imparted to the fabric and carried away. Accordingly, periodic replenishment of the processing solution is required. For this purpose, the sensor element 33 is adjusted to predetermined to upper and lower level limits of the solution. These limits advantageously are relatively narrow in order to assure uniformity of processing conditions. Preferably the difference between the high and low levels is about one-half inch, representing a volumetric difference of only about 2-3 quarts of liquid.

When the sensor 33 indicates the solution level has reached a predetermined lower limit, a mix-on-demand replenish cycle is initiated, in which the solenoid valves 54, 55 are opened for a short interval of time admitting chemical solution from the tank 48 and water from a source 56 into the intake manifold 37. This is a timed injection of water and chemical. For example, in a preferred process according to the invention, the water valve 55 is opened for a period of 1.2 seconds and then closed for a period of about 2 seconds, and the valve 54 for the chemical concentrate is opened for a shorter period of time. This on-off cycle is repeated a few times, as necessary, until the solution reaches the preset upper level for the processing solution 32. Typically, this is a very short interval of time, inasmuch as each injection of water and chemical will add between 0.5 and 1 quart of liquid. It is contemplated that only a few such injections will replenish the pan 23 to its upper level limit.

Pursuant to the invention, the relative injection periods for water and chemical solution during the mix-on-demand replenish cycle are such that water and chemical solids are injected in substantially the same ratio as necessary to correspond with the set point for the chemical. Thus, where the set point is 2.5%, and the chemical solution as supplied from the tank 48 is at a 28% concentration, a 20-ounce injection of water will be accompanied by an injection of about 1.9 ounces of the chemical concentrate. The relative injection times are easily determined empirically and/or by calculation and can be pre-set for any desired solids set point of a given chemical.

Once the upper solution level limit is reached, the replenish cycle ends and the system immediately reverts to controlling the solution by way of the high speed, repetitive measurement data from the sensor 41.

Figure 8:
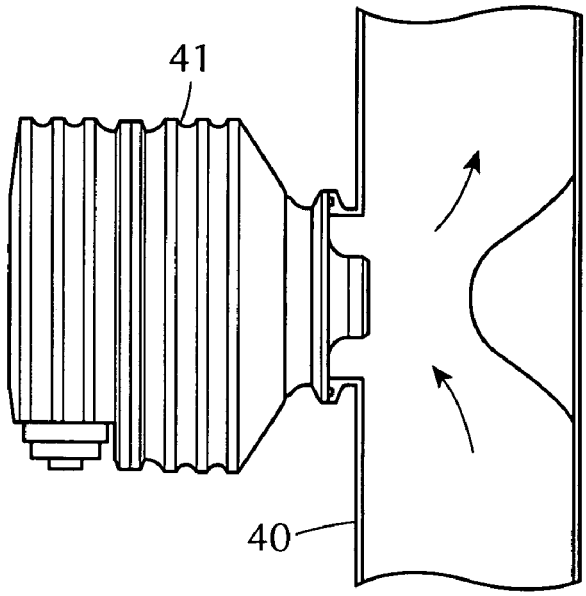
FIG. 8 is an elevational view of a preferred form of sensor device utilized in connection with the method and apparatus of invention.
Figure 9:
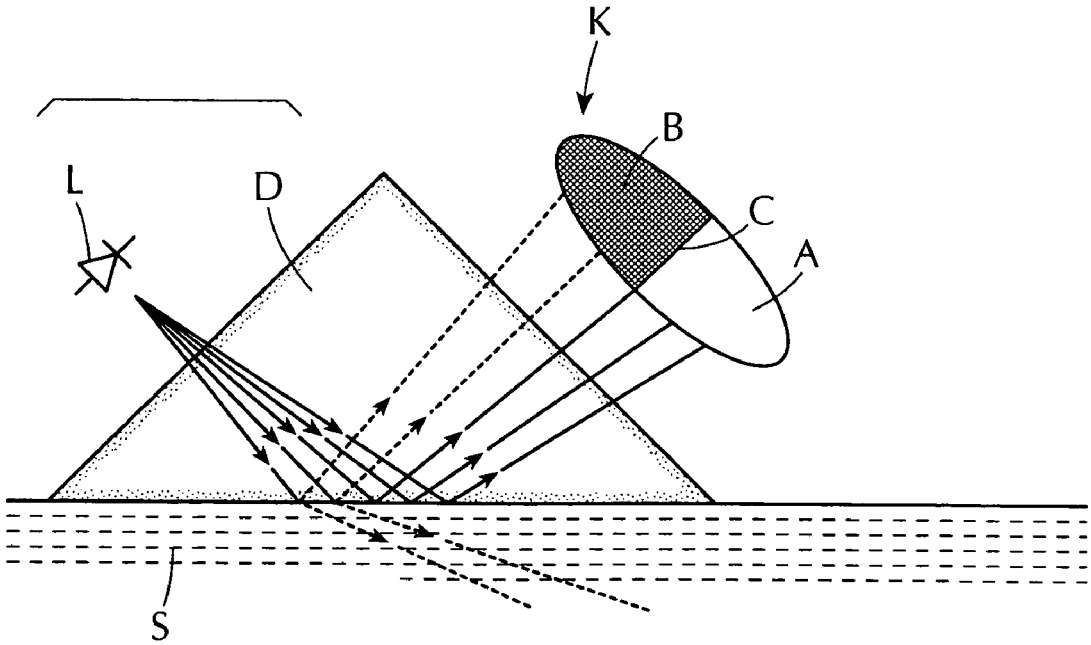
FIG. 9 is a simplified representation illustrating to operation of the sensor device of FIG. 8.

In the process of the invention, continuous precision measurement of the composition of the processing solution is highly significant. To this end, the sensor 41 preferably is a commercially available device marketed by K-Patents Process Instruments, under its designation Process Refractometer PR-03-D. This item is indicated to be covered by U.S. Pat. No. 6,067,151, the disclosure of which is incorporated herein by reference. The sensor 41 (FIGS. 8, 9) is mounted to position a reflecting prism P in surface contact with the recirculating solution S flowing through the line 40, on the exit side of the static mixer 38 and pump 39. A light beam L is directed into the prism P, and light is both reflected and refracted from the liquid-prism interface and detected by means of a CCD camera element K contained in the unit 41. A digital image is thus detected by the camera element ands records the spectrum of reflected and refracted light in adjacent areas A, B, and C. The digital image recorded by the sensor 41 enables the device to be calibrated to a high degree of accuracy and sensitivity against various concentrations of chemical in the process solution, and a digital output signal is generated as a function of the percent solids of the chemical within the recirculating solution.

At any time that the output signal from the sensor 41 indicates a chemical content less than specified, a micro-addition of the chemical is called for and the solenoid valve 55 is momentarily opened. The system according to the invention provides a virtually instantaneous adjust-on-the-fly facility for maintaining the chemical content very tightly at specification levels during processing, and a mix-on-demand system enabling the solution to be regularly replenished by the separate additions of water and chemical without disturbing the high level of accuracy of the make-up of the solution.

Figure 2:
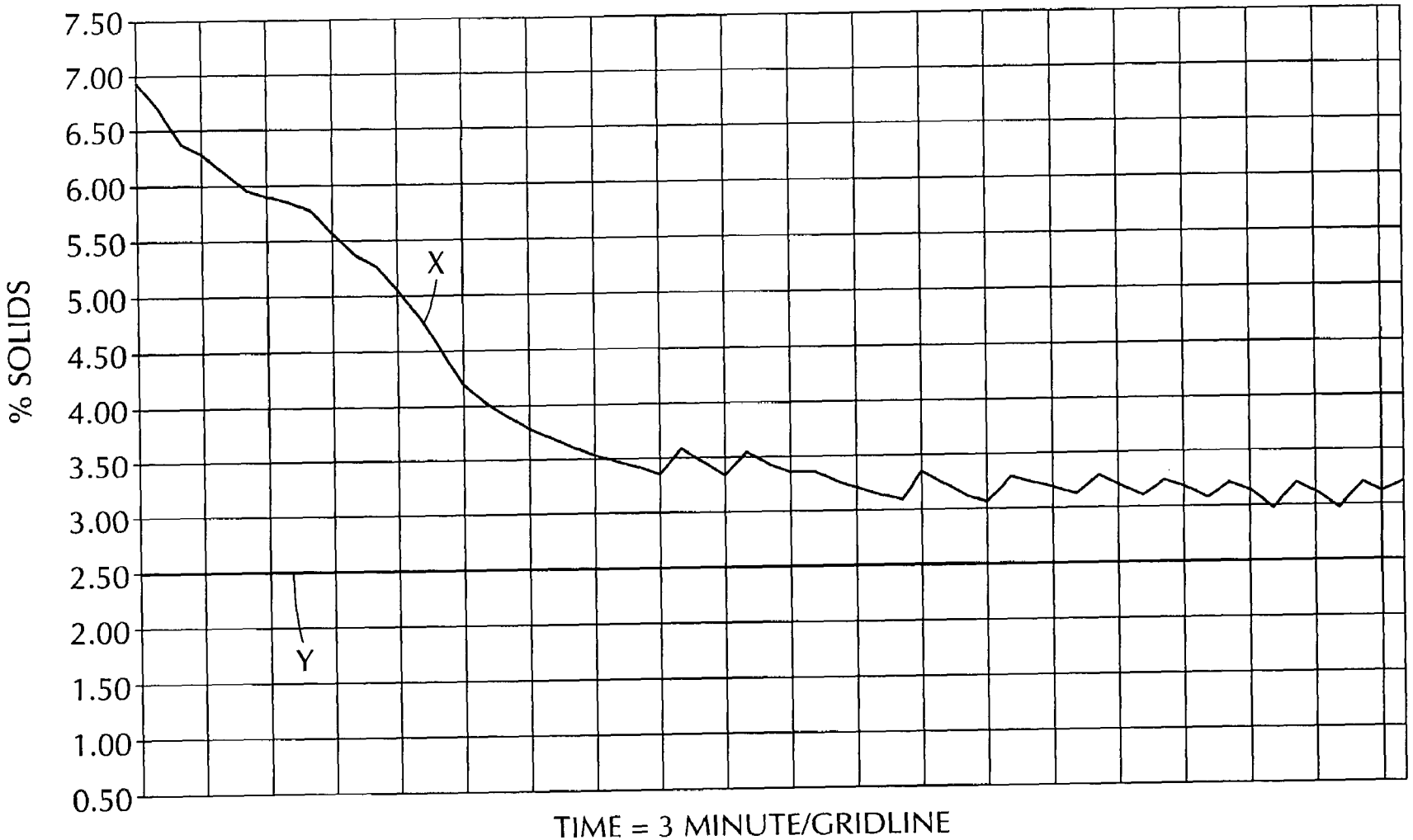
FIG. 2 is an illustrative graph showing a comparison of chemical concentration in a processing solution utilizing existing, conventional procedures (upper curve) and procedures of the invention (lower curve).

FIG. 2 of the drawings is a comparative graph illustrating the dramatic benefits of the new apparatus and procedure as compared to current industry practices. The vertical scale of the graph represents percent solids of the process chemical (in this instance a soil resist) in the process solution. The horizontal scale of the graph represents time in three-minute intervals. Approximately one hour's processing time is reflected in the graph. In the process illustrated by FIG. 2, the processor seeks to provide a solids content in the finished fabric that will assure adequate soil resist qualities through the fabric. Typically, with conventional processing, using a pre-mixed solution, the parameters are chosen to achieve a solids content in the solution bath, at equilibrium conditions, of around 3%. Experience has shown that, in order to achieve a 3% equilibrium, the solution bath, the pre-mixed solution must contain about 7% solids.

As reflected in the upper curve X in FIG. 2, when processing pan is initially filled the bath is at 7% solids. However, as processing is initiated, and wet-out fabric is passed through the bath, water is introduced on a net basis and chemical is removed by the exiting fabric, resulting in a gradual dilution of the bath. Over a period of some 20 to 30 minutes, the solids content of the processing solution approaches the 3% equilibrium level, varying somewhat at that level as the result of periodic introductions of 7% pre-mix to replenish the bath. Especially during the first 20-30 minute start-up period of each batch (usually 100 gallons of pre-mix), there is a very significant over-application of the process chemical. This results in a huge economic loss based on chemical cost alone. Moreover, the over-application of chemical causes additional economic loss in downstream processing, such as drying and compacting (compressive shrinking), by requiring more extensive processing, as well as more frequent equipment maintenance and down time.

The lower "curve" Y in FIG. 2, which is virtually a straight line, illustrates the percent solids in a processing bath achieved by the process and apparatus of this invention. The mix-on-demand system of the invention enables the solids content of the bath to be established and maintained at a predetermined level, in this case 2.5%, with a tolerance level of +/−0.05%. The advantages flowing from this are enormous. One of the most obvious is that the entire 20-30 minute interval for achieving equilibrium in a conventional system is avoided, with very significant economies both direct and indirect. A less obvious but nevertheless significant advantage of the invention lies in the fact that, by reason of the exceptional accuracy with which the solution bath can be controlled, it is not necessary to provide for a large factor of safety in the set point for chemical solids in the solution. Thus, in the illustration of FIG. 2, a set point of 2.5% for the process of the invention can be utilized whereas a standard of 3% solids is considered appropriate to achieve similar results by conventional means. Indeed, with the new method and apparatus, the set point may be reduced even further, with experience in processing a particular fabric with particular chemical, to a level providing a near zero factor of safety because significant variations in the consistency of the solution bath over an entire processing operation may be substantially ruled out. With conventional processing, on the other hand, the equilibrium set point of the chemical customarily is set higher than necessary in order to avoid any part of the processed fabric having less than the specified amount, which might result in the fabric being rejected on a quality control basis.

Figure 4:
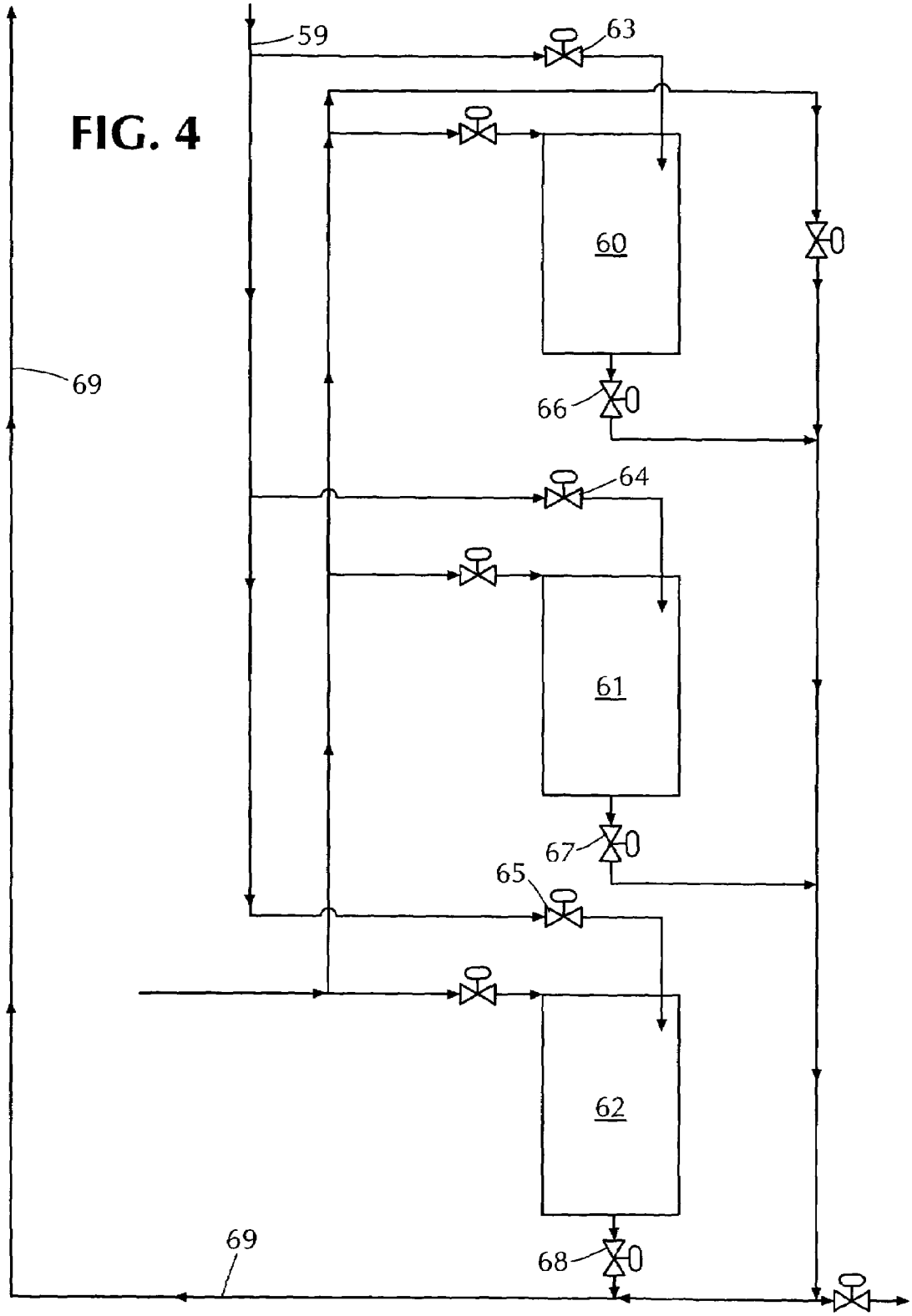

In FIG. 4 of the drawings there is shown a portion of the system that can be used for temporary storage and recycling of solution chemicals between processing operations. Thus, at the end of a particular processing operation, the system operator may choose, by controls to be described, to save the residual solution remaining in the pan 23 or cause it to be discharged. If it is to be discharged, the return solenoid valve 43 (FIG. 3) is closed and discharge solenoid valve 57 is opened, causing the output of the recirculating pump 39 to be directed to a discharge collection point (not shown). If the residual is to be saved for recycling, the discharge solenoid valve 57 remains closed and a recycle solenoid valve 58 opens. The process solution is thus directed via line 59 to one of three storage vessels 60-62 (FIG. 4) provided for holding different solutions. Each of the storage vessels is provided with a solenoid operated inlet valve 63-65 to control which vessel receives the solution.

As and when it is desired to re-use solution from one of the storage vessels 60-62, a selected solenoid valve 66-68 is actuated, allowing solution from the selected vessel to flow through a return line 69 and recycle solenoid valve 70 to the pump inlet manifold 37.

Figure 5:
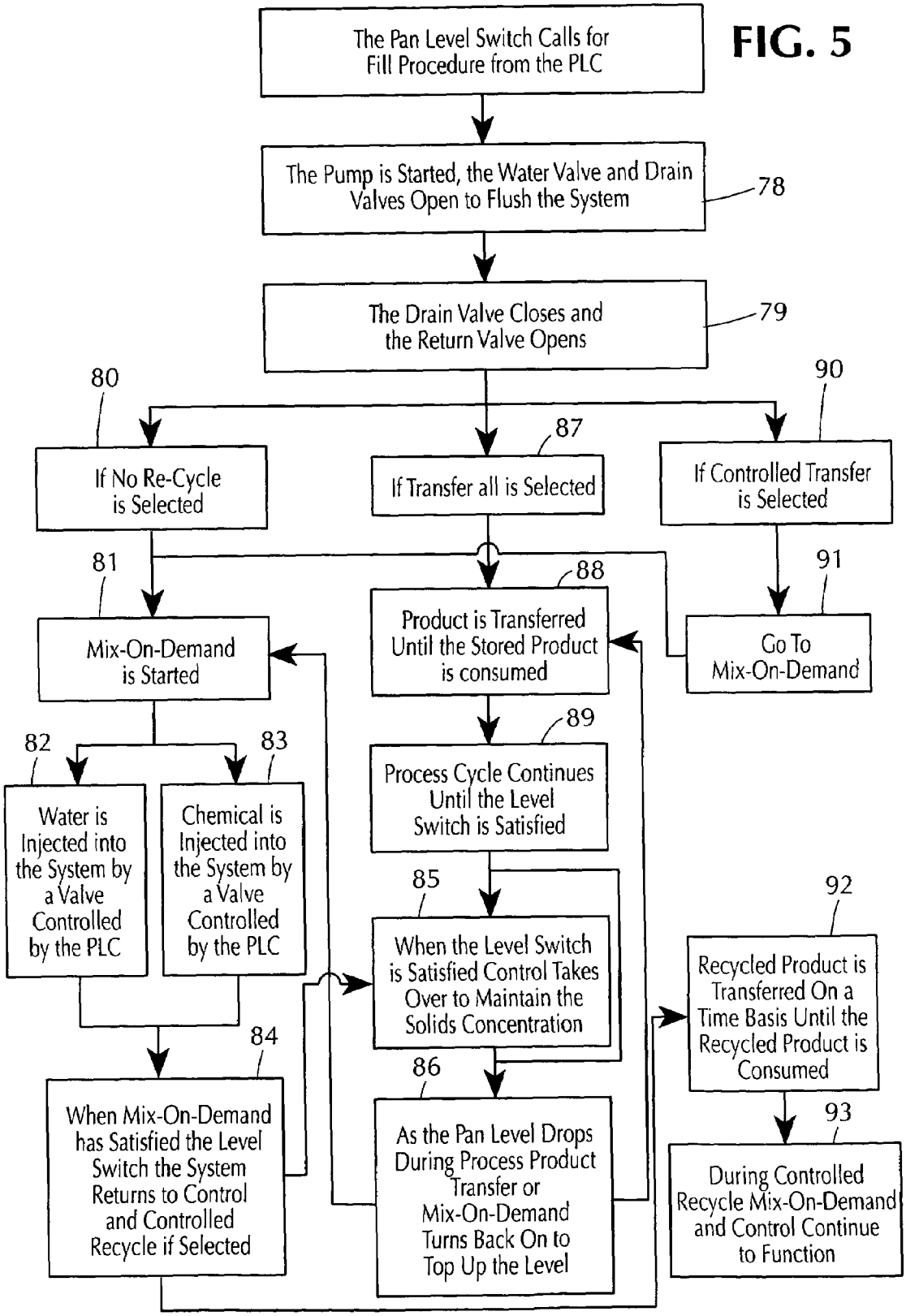
FIGS. 5-7 are simplified control flow diagrams illustrating the steps involved in controlling a typical system according to the invention.
Figure 6:
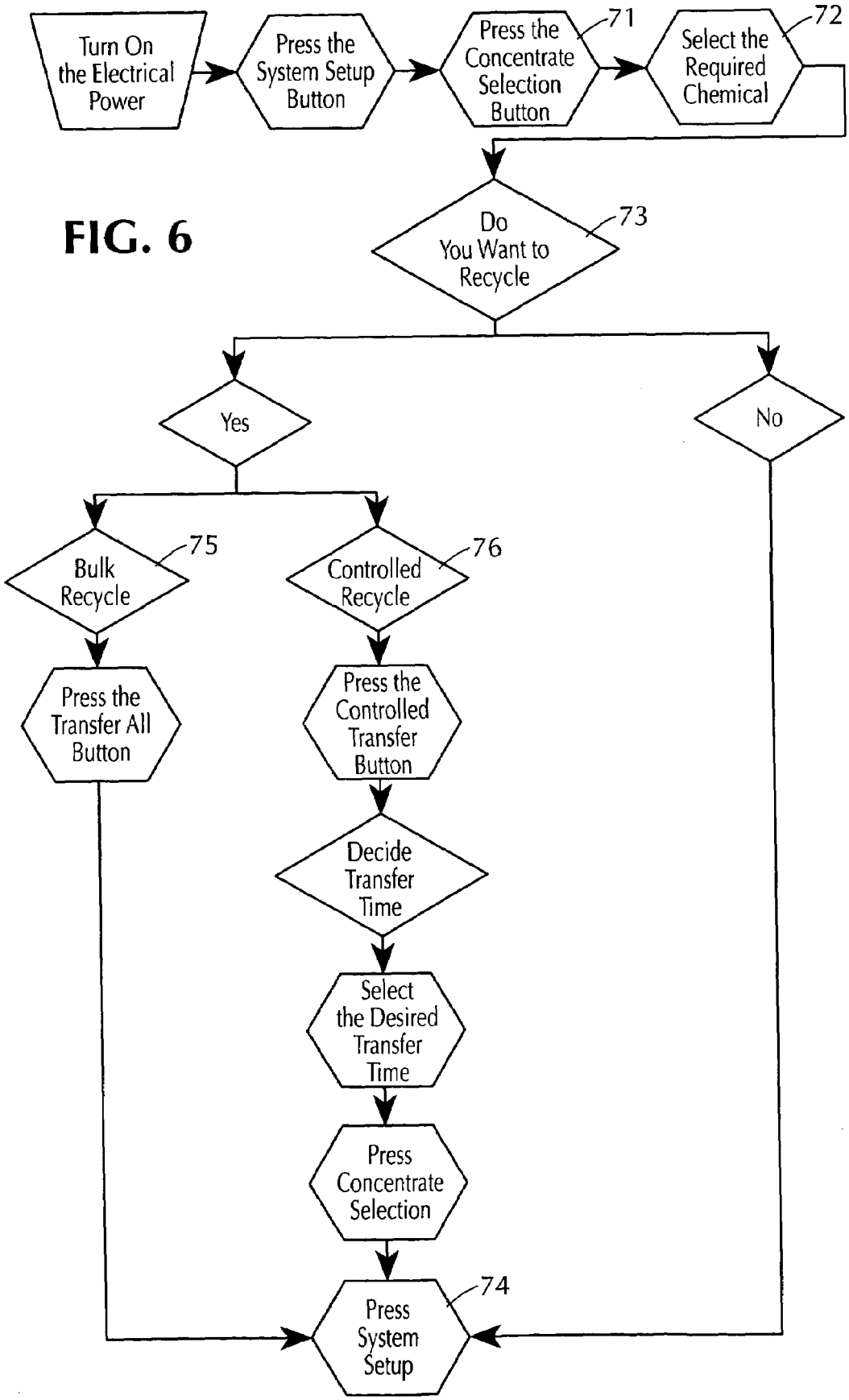
Figure 7:
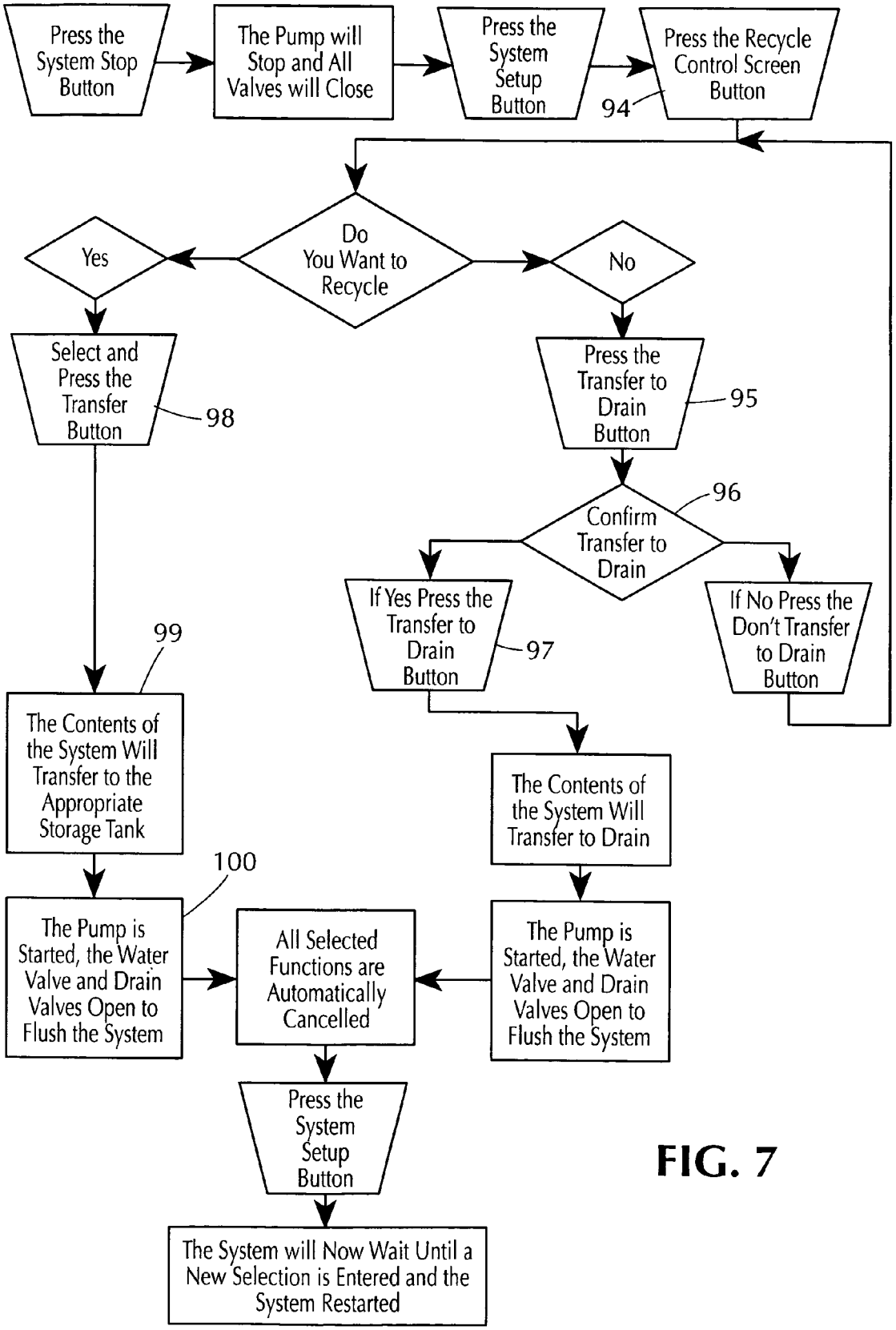

FIGS. 5-7 of the drawings are schematic control diagrams illustrative of the system of the invention, reflecting basic logic steps in carrying out the process. FIG. 6 represents certain of the steps involved in start-up of the system. FIG. 7 represents steps involved in terminating a particular processing operation. FIG. 5 illustrates various of the steps involved in a typical processing operation according to the invention.

At start up (FIG. 6) a process supervisor makes a selection at 71, 72 of the chemical and concentration level for a particular processing of a particular fabric. For example, process selections may include fabric softener, soil resist, etc., and at a specified percent solids for the particular fabric. Next, there is a selection at 73 whether or not to use (recycle) stored chemicals from a previous operation from the storage vessels 60-62. If no recycling is to be involved, the control proceeds directly to the system setup and start control at 74. If stored chemicals are to be re-used, the procedure may involve maximum utilization of the stored chemical solution for replenishment (Bulk Recycle 75) or a controlled introduction of the stored chemical solution interspersed with "normal" introductions of water and chemical concentrate (Controlled Recycle 76). If Controlled Recycle is to be performed, the system operator selects a desired transfer time interval at 77 (FIG. 6) for introduction of stored solution, when called for.

The primary operations logic diagram is reflected in FIG. 5. At start up, the water and drain valves 56, 57 are opened and the pump 39 is actuated (box 78) to provide an initial flush-out of the system. After a short flush period, the water and drain valves close and the recirculation valve 43 is opened (box 79). If no stored chemicals are to be recycled (box 80), regular mix-on-demand control is initiated (box 81), and the system proceeds as described above. Controlled and timed injections of water and chemical concentrate are introduced from the water source 56 and one of the chemical supply containers 48-50 (boxes 82, 83), until the level sensor 33 in the solution pan 23 is satisfied (box 84). Thereafter, and until the level sensor calls for replenishment, the system is controlled by the sensor 41 (box 85), which causes periodic micro-injections of the chemical concentrate via the solenoid valve 54 whenever the sensor senses a reduction in the solids content of the solution resulting from dilution of the chemical solution during processing of the wet fabric. Periodically, for example when the level of the processing solution 32 drops by, say, one-half inch, the level sensor 33 calls for replenishment (box 86) and the control returns to mix-on-demand at box 81. This cycle of continuous control, by the sensor 41, and periodic replenishment on a mix-on-demand basis continues throughout the entire processing operation.

Where Bulk Recycle is selected at start-up, the initial fill of the processing pan 23 proceeds by way of logic box 87. Stored processing solution from a selected one of the storage vessels 60-62 is supplied through line 69 (FIG. 4) and recycle solenoid valve 70 to the inlet manifold 37 of the pump 39. The processing pan is thus filled directly with recycle solution until the level sensor 33 is satisfied, or until the stored supply has been completely exhausted (logic boxes 88, 89). If the level sensor has not been satisfied (i.e., the stored supply has been exhausted) the mix-on-demand control (box 81) takes over to complete the fill or replenish operation. In either case, once the pan 23 is filled, control by the sensor 41 (box 86) maintains the processing solution under precise solids control until a further replenishment is called for by the sensor 33. Any replenishment of the solution pan 23 called for by the level sensor 33 is satisfied from the selected storage vessel until all recycle solution is exhausted, after which the system operates in the normal manner, with replenishment being derived by mix-on demand control via logic box 81.

If Controlled Transfer of recycle chemical is selected (box 90) the system calls for the initial fill to be made with new chemicals by way of the previously described mix-on-demand procedure (boxes 91, 81). Thereafter, a time-controlled introduction of recycled solution is made (boxes 92, 93). To the extent that this is insufficient to satisfy the level sensor 33, the solution level is maintained by mix-on-demand procedures to complete the replenishment. In all cases, the processing solution is continuously monitored and controlled between replenishment cycles by means of the sensor 41 to maintain the desired tight tolerances on the composition of the solution.

At the end of a processing operation, a shut-down procedure (FIG. 7) is preferably followed in order to deal with residual processing solution in the system. At the control panel, a recycle selection is made by the operator (box 94). If the residual solution is not to be recycled, the operator selects and confirms the procedure (boxes 95-97). This activates the pump 39 and opens the water and drain valves 55,57. The return valve 43 may be opened momentarily to flush out the filter 45 and distributors 47. All other valves are closed. After a predetermined flush-out time, the system shuts down and awaits a new cycle of operations.

If the residual solution is to be recycled, the drain valve 57 and return valve 43 remain closed and the recycle solenoid valve 58 opens (boxes 98 99), along with one of the valves 63-65, to direct the residual solution into a selected one of the storage vessels for later use. Immediately thereafter, the system is flushed by opening the water valve 55 and drain valve 57 and running the pump 39 (box 100). The system then goes on standby awaiting start-up of a new processing cycle.

The process and apparatus of the invention, particularly as applied to wet-on-wet processing of fabrics represents an exceptional advance in preventing over-application of chemicals as heretofore practiced. The benefits are realized not only in the initial portion of the operating cycle, while the processing bath is reaching equilibrium from a condition of initial significant over concentration of chemical, but also in the ability of the new system to control the processing solution at all times to extremely tight tolerances. By being able to control to very tight tolerances, it is possible to set the chemical set point significantly lower than otherwise, because it is not necessary to provide for a significant factor of safety in order to avoid under application of the chemical. This is made possible by the ability of the system to deliver processing solution on a mix-on-demand basis to the exact proportions required, both for the initial fill of the solution pan, and for the replenishment cycles required as the solution is consumed during processing.

Between replenishment cycles, the composition of the processing solution is maintained very precisely to the desired specifications by recirculating the entire content of the solution pan at a high rate of repetition (multiple times per minute), measuring the concentration of the recirculating solution by means of a sensor, and making micro-injections of chemical concentrate as and when necessary to maintain the processing solution at specification levels. Thus, even though incoming wet fabric is constantly adding water to the processing solution, the periodic micro-injections of chemical concentrate, when called for, serve to maintain the solution at the desired specification, within a tolerance of less than one tenth percent. Because of the high rate of recirculation of the processing bath, the contact surface of the sensor can be kept very clean, and the control can be both accurate and repeatable.

With conventional processing, not only is there a significant period required to reach equilibrium, but as the solution pan is replenished periodically during extended processing the chemical concentration in the bath tends to spike upward as the pre-mixed solution is added, and then gradually reduce as the incoming fabric results in a net addition of water prior to the next replenishment. The result is a "saw tooth" curve of concentration levels, which necessarily results in continuing overapplication of chemicals in order to assure minimum levels over the entire process batch.

In the wet-on-wet processing of fabrics, the dilution of the processing solution by incoming wet fabric can vary significantly as a function of the fabric width, weight, and throughput speed. The system of the invention is not affected in any way by this variability, because of the high circulation rate of the processing solution and the rapid and repetitive measuring of the solution throughout the processing operation. With conventional processing, on the other hand, different fabric widths, weights and throughput speeds can result in different equilibrium points, adding another undesirable variable to the process control.

The process of the invention also eliminates altogether the periodic solution dumping often required with conventional processing, in which the solution may from time to time become diluted below the required standard for percent solids. In such cases, it is common for the processor to simply dump and dispose of the entire pan of dilute solution and refill with new solution. The loss of solution alone represents a significant economic loss (in some cases as much as $2000.00 per week in an active processing operation), but also the processing line must be stopped during the dump and refill operations, and thereafter the process must go through a new equilibrium, in which the somewhat over-concentrated initial solution gradually becomes diluted down toward the desired specification level of the processor.

With the process and apparatus of the applicant's invention, huge savings can be realized in chemical costs alone, not only because of the complete elimination of an initial period to reach equilibrium at the beginning of each process operation, but also because of the ability to utilize a lower percent solids concentration set point throughout the operation, as compared to a typical equilibrium standard for conventional operations. For some chemicals, such as soil release chemicals, flame retardants, resins, etc., the cost per pound of the chemical can be very significant. A soil release, for example, for a given fabric, may cost around 12-14 cents per pound of fabric applied at a "standard" 3% solids. By accurately controlling the percent solids set point at 2% using the processes of the invention, a direct savings of around 4 cents per pound can be realized. During the 20-30 minute equilibrium period at the start-up of a conventional process with a 7% solids concentration, the comparable savings realized by the new process can amount to almost 30 cents per pound of fabric at the start, gradually reducing to around 4 cents per pound as equilibrium is reached at around 3% solid content.

The direct savings derived from the invention, while extraordinary in themselves, do not represent the entire benefit. Important benefits are realized in downstream processing, such as drying, drying and curing, and compacting. With overapplication of chemicals, drying energy is increased, and dryer maintenance and downtime is increased. Likewise, compacting operations suffer efficiency losses and greater maintenance problems. In some cases, the process of the invention makes possible the wet-on-wet treatment of fabrics heretofore required to be processes wet-on-dry. In addition to achieving generally superior results by processing on a wet-on-wet basis, the procedure avoids an expensive additional drying step otherwise required for wet-on-dry processing.

The additional step can easily involve extra expense of, for example, nine cents per pound of fabric.

While the process and apparatus of the invention have particular and unique advantages in connection with wet-on-wet processing of fabrics, the mix-on-demand concepts employed may have wide application in connection with a variety of processes involving mixing and consumption of liquids, where such liquids currently are mixed on a batch basis and consumed over time.

It should thus be understood that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A method of processing a continuously moving web of wet fabric by the addition of a processing chemical thereto, which comprises, (a) providing a processing pan having a limited volumetric capacity for containing a small quantity of processing solution, including said processing chemical as a minor component and water as a major component in predetermined proportions, (b) the volumetric capacity of said processing pan being such that only a small portion of the moving fabric web is exposed to the processing solution at any time, (c) providing separate valve-controlled sources of a concentrated solution of said processing chemical in water and of said water, (d) continuously passing said wet fabric into and through said processing solution in a manner causing fabric to pick up and remove a first quantity of processing solution from said processing pan while the fabric causes the continuous introduction into said processing pan of a quantity of water which is dilutive of the processing solution, (e) continuously withdrawing processing solution from said processing pan and recirculating said withdrawn solution back to said processing pan, (f) said step of continuously withdrawing and recirculating said processing solution including a pumping stage, a mixing stage, and a measuring stage, (g) said pumping and mixing stages taking place in advance of said measuring stage, (h) the volumetric rate per minute of recirculation of said processing solution being greater than the volumetric capacity of said processing pan, (i) rapidly and repetitively measuring the content of said processing chemical in the continuously flowing, recirculating stream of said processing solution, (j) said step of rapidly and repetitively measuring the content of said processing chemical being performed by an in-line optical sensor positioned in optical exposure to the continuously flowing, recirculating processing solution, and (k) adding supplemental amounts of said concentrated solution of said processing chemical to said continuously flowing, recirculating solution as required in order to continuously maintain said predetermined proportions of said processing chemical and water in said processing solution, (l) the steps of adding supplemental amounts of said processing chemical including introducing said processing chemical into the continuously flowing, recirculating solution at a location in advance of said pumping and mixing stages.

2. The method of claim 1, wherein (a) the level of processing solution in said pan is continuously sensed, (b) in response to the level of said processing solution becoming lower than a predetermined level, initiating a cycle of replenishing said processing solution by introducing additional quantities of both water and processing chemical in said predetermined proportions into the continuously flowing, recirculating processing solution until the level of processing solution is increased to a level above said predetermined level, and (c) within each replenishing cycle introducing said water and said processing chemical in multiple injections with a short time interval between such injections.

3. The method of claim 1, wherein (a) said processing solution is withdrawn and recirculated at a volumetric rate per minute which is a multiple of at least three times the volumetric capacity of said processing pan.

4. The method of claim 3, wherein (a) the measuring of the content of said processing chemical in the flowing stream of said recirculating processing solution takes place multiple times for each period of time in which the volumetric capacity of said processing pan is recirculated.

5. The method of claim 1, wherein (a) said processing chemical is introduced at a predetermined flow point in the recirculation of said processing solution, and (b) said measuring step is performed at a flow point in said recirculation located downstream of said predetermined flow point.

* * * * *